US006165353A

United States Patent [19]

Carpenter et al.

[11] Patent Number: 6,165,353

[45] Date of Patent: Dec. 26, 2000

[54] DISTRIBUTION APPARATUS AND METHOD FOR PATTERNED FEED INJECTION

[75] Inventors: Brandon Scott Carpenter, Chicago; Daniel N. Myers, Arlington Heights, both of Ill.

[73] Assignee: UOP LLC, Des Plaines, Ill.

[21] Appl. No.: 09/168,236

[22] Filed: Oct. 8, 1998

[51] Int. Cl.[7] ..... C10G 35/10

[52] U.S. Cl. ..... 208/146; 208/113; 208/120.01; 208/153; 422/139; 422/207; 422/194; 239/407; 239/413; 239/416.5; 239/417.5

[58] Field of Search ..... 208/113, 120.01, 208/146, 153; 422/139, 207, 194; 239/407, 413, 416.5, 417.5

[56] References Cited

U.S. PATENT DOCUMENTS

| | | | |
|---|---|---|---|
| 3,071,540 | 1/1963 | McMahon et al. | 208/163 |
| 3,524,731 | 8/1970 | Effron et al. | 422/220 |
| 3,915,847 | 10/1975 | Hutchings | 208/146 |
| 4,434,049 | 2/1984 | Dean et al. | 208/153 |
| 4,717,467 | 1/1988 | Haddad et al. | 208/113 |
| 4,985,136 | 1/1991 | Bartholic | 208/153 |
| 5,108,583 | 4/1992 | Keon | 208/157 |
| 5,160,706 | 11/1992 | Khouw et al. | 422/140 |
| 5,289,976 | 3/1994 | Dou et al. | 239/431 |
| 5,296,131 | 3/1994 | Raterman | 208/113 |
| 5,462,652 | 10/1995 | Wegerer | 208/167 |
| 6,010,620 | 1/2000 | Myers et al. | 208/146 |

*Primary Examiner*—Walter D. Griffin
*Assistant Examiner*—Nadine Preisch
*Attorney, Agent, or Firm*—John G. Tolomei; James C. Paschall

[57] ABSTRACT

An arrangement for the controlled production of an essentially linear array of hydrocarbon feed injection jets maintains stable and reliable jets by passing individual piping for each jet through a support shroud that is located in a contacting vessel. Controlled atomization is provided by independently injecting a uniform quantity of gas medium into each of the plurality of uniformly created feed injection streams upstream of a discharge nozzle that separately discharges each mixed stream of hydrocarbons and gas medium into a stream of catalyst particles at or about the inner end of the support shroud. The feed injection jets are suitable for positioning in an inner location of a large contacting vessel. Uniformity of distribution is obtained by dividing the hydrocarbons streams from an oil chamber into an individual oil conduit for each spray injection nozzle. The individual oil conduits receive separate streams of a gas phase fluid that mixes with feed to pass the mixture to a spray nozzle. Each spray nozzle discharges a discrete jet of the gas and oil mixture into the vessel. An individual restrictor controls at least one of the fluid flow to each spray nozzle. A distributor shroud positions and guides the individual conduits supplying the mixture to the jets to permit extension of the jets into the interior of the vessel where the contacting occurs.

24 Claims, 4 Drawing Sheets

50
80
14
78
50
82
84
90
92
86
32
10
28
19
88
26
30
17
20
22
24
68
66
74
21
13
15
64
48
12
46
58
36
33
34
60
52
18
16
54
62
56
70
72
38
40
76
42
42
44
42

DISTRIBUTION APPARATUS AND METHOD FOR PATTERNED FEED INJECTION

BACKGROUND OF THE INVENTION

1. Field of the Invention

This invention relates generally to the dispersing of liquids into fluidized solids. More specifically this invention relates to a method and apparatus for dispersing a hydrocarbon feed into a stream of fluidized catalyst particles.

2. Description of the Prior Art

There are a number of continuous cyclical processes employing fluidized solid techniques in which an at least partially liquid phase stream containing hydrocarbon compounds contacts the fluidized solids in a contacting zone and carbonaceous or other fouling materials are deposited on the solids. The solids are conveyed during the course of the cycle to another zone where foulants are removed in a rejuvenation section or, more specifically, in most cases carbon deposits are at least partially removed by combustion in an oxygen-containing medium. The solids from the rejuvenation section are subsequently withdrawn and reintroduced in whole or in part to the contacting zone.

One of the more important processes of this nature is the fluid catalytic cracking (FCC) process for the conversion of relatively high-boiling hydrocarbons to lighter hydrocarbons. The hydrocarbon feed is contacted in one or more reaction zones with the particulate cracking catalyst maintained in a fluidized state under conditions suitable for the conversion of hydrocarbons.

It has been a long recognized objective in the FCC process to maximize the dispersal of the hydrocarbon feed into the particulate catalyst suspension. Dividing the feed into small droplets improves dispersion of the feed by increasing the interaction between the liquid and solids. It is well known that agitation or shearing can atomize a liquid hydrocarbon feed into fine droplets which are then directed at the fluidized solid particles. A variety of methods are known for shearing such liquid streams into fine droplets. U.S. Pat. No. 3,071,540 discloses a feed injection apparatus for a fluid catalytic cracking unit wherein a high velocity stream of gas, in this case steam, converges around a stream of oil upstream of an orifice through which the mixture of steam and oil is discharged. Initial impact of the steam with the oil stream and subsequent discharge through the orifice atomizes the liquid oil into a dispersion of fine droplets which contact a stream of coaxially flowing catalyst particles. U.S. Pat. No. 4,434,049 shows a device for injecting a fine dispersion of oil droplets into a fluidized catalyst stream wherein the oil is first discharged through an orifice onto an impact surface located within a mixing tube. The mixing tube delivers a cross flow of steam which simultaneously contacts the liquid. The combined flow of oil and steam exits the conduit through an orifice which atomizes the feed into a dispersion of fine droplets and directs the dispersion into a stream of flowing catalyst particles.

Other known methods for feed dispersion include specific injection methods. U.S. Pat. No. 4,717,467 shows a method for injecting an FCC feed into an FCC riser from a plurality of discharge points. U.S. Pat. Nos. 5,108,583 and 5,289,976 disclose a method wherein hydrocarbons and steam are supplied from individual headers or chambers and combined in one or more conduits to supply a steam and hydrocarbon mixture to a distribution nozzle for injection into an FCC riser. U.S. Pat. No. 5,160,706 shows the delivery of a diluent and hydrocarbon mixture from a plurality of conduits into a riser.

The processing of increasingly heavier feeds in FCC type processes and the tendency of such feeds to elevate coke production and yield undesirable products has led to new methods of contacting feeds with catalyst. Of particular recent interest have been methods of contacting FCC catalyst for very short contact periods. U.S. Pat. No. 4,985,136, the contents of which are hereby incorporated by reference, discloses an ultrashort contact time process for fluidized catalytic cracking, that contacts an FCC feed with a falling curtain of catalyst for a contact time of less than 1 second followed by a quick separation. U.S. Pat. No. 5,296,131, the contents of which are hereby incorporated by reference, discloses a similar ultrashort contact time process that uses an alternate falling catalyst curtain and separation arrangement. The ultrashort contact time system improves selectivity to gasoline while decreasing coke and dry gas production by using high activity catalyst that previously contacted the feed for a relatively short period of time. The inventions are specifically directed to zeolite catalysts having high activity.

The type of injection desired for short contact time arrangements poses special problems for the injection of the feed into the catalyst. Most desirably the feed is injected in an array of identical feed injection streams that uniformly contact a stream of catalyst flowing in a compatible pattern. Typically, feed injection nozzles shoot the feed into a thin band of catalyst that falls in a direction at least partially transverse to the flow of jets. The jet array should extend over the width of the thin band which greatly exceeds its depth. In other words, the arrangement usually creates a vertical line of catalyst that is contacted by an array of jets that extends over a horizontal line. Establishing the thin but extended band of catalyst requires equipment that usually places the band toward the center of a contacting vessel. In turn the nozzles that create the jets must also be located close to the band of catalyst. Creating an extended array of jets at a location removed from the wall of the contacting vessel creates distribution and structural problems. The distribution problems require that equal amounts of gas and oil reach each nozzle that defines the individual jet. From the structural side, providing a reliable assembly of nozzles demands that the distributor withstand the possible erosive effects of the catalyst and the vibration effects imposed by the large flowing mass of catalyst and the cyclic input from numerous pieces of equipment.

SUMMARY OF THE INVENTION

An object of this invention is to reliably and consistently deliver a uniform mixture of a gas phase stream and an at least partially liquid phase oil stream in an extended array ofjets to a patterned stream of flowing catalyst.

A further object of this invention is to increase the dispersion of a mixed phase stream over the flowing surface area of a thin catalyst band.

This invention is a distributor nozzle arrangement and a distribution method for delivering, through a uniform linear array of feed jets, a feed comprising mixed phase media into an extended thin band of catalyst. The distributor uses at least two chambers for separate distribution of gas and an at least partially, more often completely, liquid phase oil stream. Each chamber delivers a uniform amount of gas phase media, typically steam, and oil to a plurality of gas and oil distribution pipes. Pairs of the oil and gas distribution pipes discharge oil and gas, respectively, into conduit sections that mix the oil and gas and deliver the mixture to a spray nozzle. The common ends of the conduit sections located opposite the spray nozzles are fixed with respect to a supporting shroud. The ends of the conduit sections to which the spray nozzles are attached are supported by an opposite end of the shroud. The invention solves the problem of providing a linear array of spray jets at a location close to a falling curtain of catalyst that is located in a large vessel and away from the wall of the vessel.

Accordingly, in a method embodiment of this invention a substantially linear array of feed jets injects a feed comprising at least partially liquid phase hydrocarbon compounds and a gas phase fluid into a stream of fluidized particles. The method passes a dispersion of moving catalyst particles through the contacting vessel in a predetermined flow pattern. A first chamber divides a stream of hydrocarbon compounds into a plurality of hydrocarbon substreams by passing the stream of hydrocarbon compounds into first inlets of different conduits in a plurality of first conduits. A second chamber divides a stream of gas phase material into a plurality of uniform gas substreams by passing each of the gas substreams into second inlets of the conduits in the plurality of first conduits or the inlets of different conduits in a plurality of second conduits. The gas substreams or the hydrocarbon substreams pass along a linear path through conduits of the first or second plurality of conduits to produce a plurality of linearly directed flow streams. The gas substreams or the hydrocarbon substreams pass through flow restrictors to provide a plurality of restricted flow streams. Combining each of the gas substreams with the hydrocarbon substreams at a location downstream of the flow restrictors and the linear flow path in the conduits of the first or second plurality of conduits provides a plurality of combined streams directed along a linear flow path. The method maintains the plurality of combined streams as discrete streams and injects the discrete streams from outlet ends of the plurality of the first conduits or the plurality of the second conduits into different portions of the predetermined catalyst flow pattern. An additional feature of this invention comprises a shroud for guiding the outlet end of each conduit that delivers the combined stream to a nozzle at each outlet end and that protects the conduit from the harsh conditions imposed by the catalyst contacting.

Typically, the predetermined pattern of the catalyst entering the vessel produces a planar sheet of catalyst that receives atomized hydrocarbon compounds. The catalyst normally has a velocity of at least 5 ft/sec when contacted by the discrete streams of atomized hydrocarbon discharged by the outlet ends of the conduits. The most common discharge pattern of the atomized hydrocarbons is as a substantially linear array of discrete streams. Atomization typically discharges the hydrocarbons from the nozzles in a droplet size of from 50 to 750 $\mu$m with a velocity of at least 10 ft/sec imparted to each discrete stream discharged from a nozzle. Atomization in most cases will use steam as the gas with the amount of steam equaling 0.2 to 5 wt % of the combined streams. The nozzles that produce the discrete jets of atomized hydrocarbons may be angled as desired to cover any length or width of contact area for a particular catalyst dispersion pattern.

Mixing of the gas and the hydrocarbons may be accomplished with different conduit configurations. In one method a portion of each conduit in the plurality of first conduits may pass through the second chamber. Holes in the portion of each conduit that occupies the second chamber provide the second inlets of the conduits in the plurality of first conduits and provide the flow restrictors. The method usually divides a central stream of hydrocarbon compounds into a plurality of uniform hydrocarbon substreams and divides a central stream of gas into a plurality of uniform gas substreams. The number of hydrocarbon substreams will commonly equal the number of gas substreams such that individual conduits combine each of the gas substreams with one of the hydrocarbon substreams to provide a plurality of combined streams that are each carried by the individual conduits.

Different physical arrangements of the apparatus may be more fully appreciated from apparatus embodiments of the invention. These embodiments disclose an apparatus for injecting a plurality of discrete fluid jets into an extended dispersion of moving catalyst particles contained within the contacting vessel. The contacting vessel may comprise a conventional pressure vessel or a large diameter conduit of the type that typically transfers catalyst in an FCC process. In one such embodiment of the apparatus chamber walls define a first chamber for receiving a first fluid stream and a second chamber for receiving a second fluid stream. The conduit sections in a plurality of first conduit sections communicate with the first chamber and extend along distinct axes in the second chamber. Conduit sections in a plurality of second conduit sections communicate with the second chamber such that a different conduit section of the first conduit sections communicates with each second conduit section. At least one flow restrictor is supported or defined at least in part by each first conduit section and each flow restrictor communicates with the second chamber and the interior of at least a first conduit section or a second conduit section to restrict fluid flow from the second chamber into the first or second plurality of conduit sections. An outer end of each second conduit section retains a nozzle. A shroud fixed about an inner end with respect to the second chamber restricts transverse displacement of the second conduit section at a location proximate to the outer ends of the second conduit sections.

This apparatus is susceptible to many variations. As described more fully in the preferred embodiment, a common arrangement of the apparatus has second conduit sections that extend into the second chamber and each conduit section of the first plurality of conduit sections extends coaxially into a different conduit section of the second plurality of conduit sections. In an alternate arrangement, pairs of a first conduit section and a second conduit section may comprise a single pipe that occupies a middle chamber between an outer chamber and the shroud and that extends into the shroud. Inlet ends of the first conduit section receive one fluid from the outer chamber while holes in the first conduit section may receive the other of the hydrocarbon or gas from the middle chamber. The second conduit section then extends from the middle chamber into the vessel to provide the nozzles.

Additional objects, embodiments and details of this invention can be obtained from the following detailed description of the invention.

DETAILED DESCRIPTION OF THE INVENTION

Figure 1:
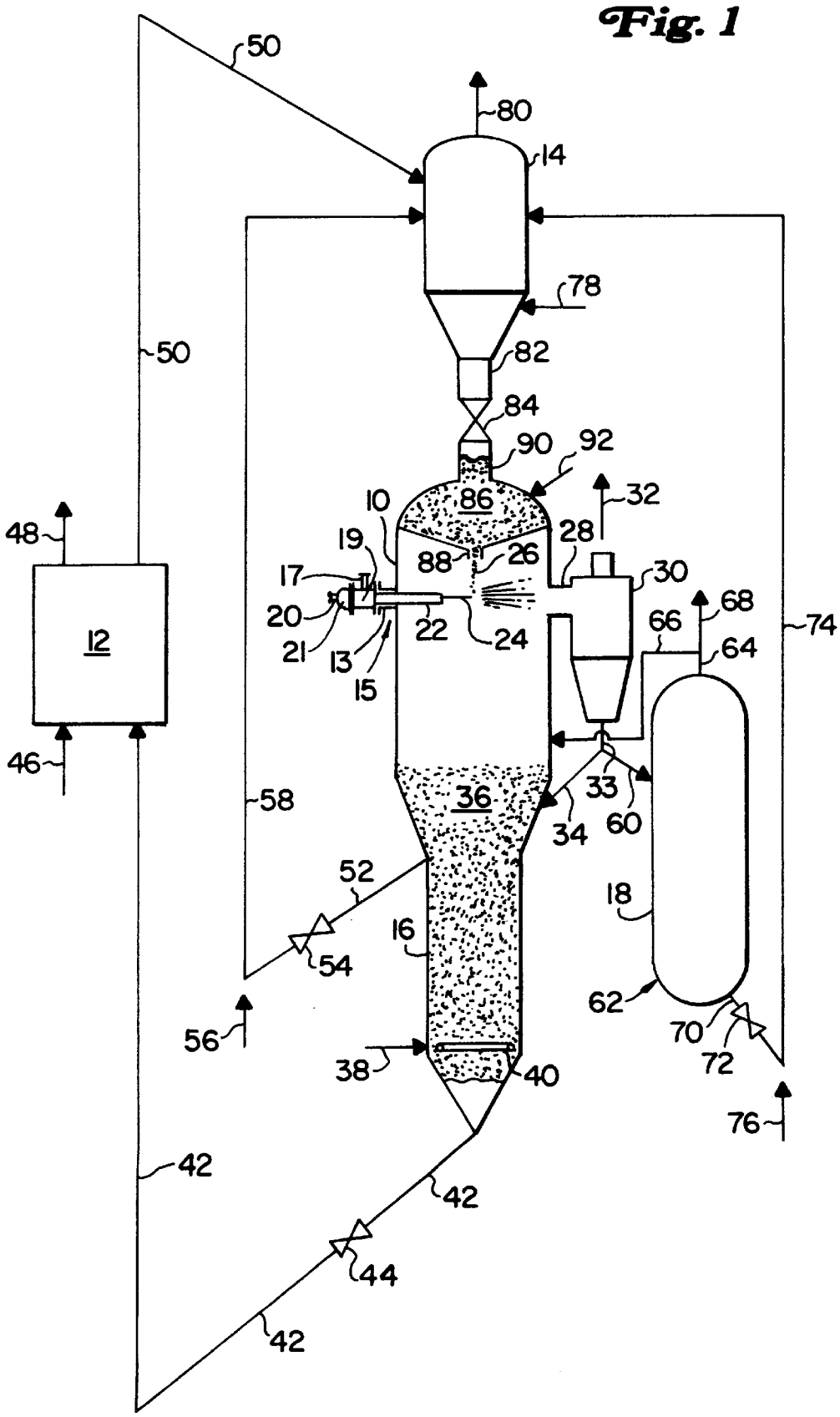
FIG. 1 is a schematic illustration of a short contact time FCC reactor arrangement that uses the distributor and method of this invention.

This invention is more fully explained in the context of an FCC process. The drawing of this invention shows a typical FCC process arrangement. The description of this invention in the context of the specific process arrangement shown is not meant to limit it to the details disclosed therein. The FCC arrangement shown in FIG. 1 consists of a reactor 10, a regenerator zone 12, a blending vessel 14 which can also serve as a secondary stripper, a primary stripping vessel 16 and a displacement stripping vessel 18. The arrangement circulates catalyst and contacts feed in the manner hereinafter described.

The catalyst used in the FCC application of the process can include any of the well-known catalysts that are used in the art of fluidized catalytic cracking. These compositions include amorphous-clay type catalysts which have, for the most part, been replaced by high activity, crystalline alumina silica or zeolite containing catalysts. Zeolite containing catalysts are preferred over amorphous-type catalysts because of their higher intrinsic activity and their higher resistance to the deactivating effects of high temperature exposure to steam and exposure to the metals contained in most feedstocks. Zeolites are the most commonly used crystalline alumina silicates and are usually dispersed in a porous inorganic carrier material such as silica, alumina, or zirconium. These catalyst compositions may have a zeolite content of 30% or more. Zeolite catalysts used in the process of this invention will preferably have a zeolite content of from 25–80 wt % of the catalyst. The zeolites may also be stabilized with rare earth elements and contain from 0.1 to 10 wt % of rare earths.

Suitable liquid media for this invention include any liquid stream that will enter the distributor as a liquid and which is mixed with a gas. For the FCC process, feedstocks suitable for processing by the method of this invention, include conventional FCC feeds and higher boiling or residual feeds. The most common of the conventional feeds is a vacuum gas oil which is typically a hydrocarbon material having a boiling range of from 650°–1025° F. and which is prepared by vacuum fractionation of atmospheric residue. These fractions are generally low in coke precursors and the heavy metals which can deactivate the catalyst. Heavy or residual feeds, i.e., boiling above 930° F. and which have a high metals content, are finding increased usage in FCC units. These residual feeds are characterized by a higher degree of coke deposition on the catalyst when cracked. Both the metals and coke serve to deactivate the catalyst by blocking active sites on the catalysts. Coke can be removed to overcome its deactivating effects by a desired degree of regeneration. Metals, however, accumulate on the catalyst and poison the catalyst. In addition, the metals promote undesirable cracking thereby interfering with the reaction process. Thus, the presence of metals usually influences the regenerator operation, catalyst selectivity, catalyst activity, and the fresh catalyst makeup required to maintain constant activity. The contaminant metals include nickel, iron, and vanadium. In general, these metals affect selectivity in the direction of less gasoline, and more coke and dry gas. Due to these deleterious effects, the use of metal management procedures within or before the reaction zone are anticipated in processing heavy feeds by this invention. Metals passivation can also be achieved to some extent by the use of an appropriate lift gas in the upstream portion of the riser.

Looking then at the reactor side of FIG. 1, FCC feed from a nozzle 17 enters a chamber 19 of a distributor 15 while an additional gas phase fluidizing medium, in this case steam from a nozzle 20, enters a chamber 21 of distributor 15. The internals of distributor 15 mix the feed and the steam and atomize the feed into streams of fine liquid droplets 24 that exit from the outer end of the distributor through a shroud 22 and contact the catalyst. The predetermined catalyst flow pattern for this embodiment discharges the catalyst over a straight line that forms a falling curtain of catalyst 26. Contact of the feed with the catalyst causes a rapid vaporization and a high velocity discharge of catalyst in the direction of a cyclone inlet 28.

Contact between the feed and catalyst cracks the heavier hydrocarbons into lighter hydrocarbons and produces coking of the most active catalyst sites on the catalyst. As the catalyst moves toward cyclone inlet 28, a portion of the catalyst particles falls from the stream of mixed catalyst and feed downwardly through the reactor vessel into the top of primary stripping zone 16. The transverse contacting of the feed with the vertically falling catalyst curtain creates a beneficial trajectory of the catalyst and feed mixture towards inlet 28. Projecting the mixture of catalyst and cracked vapors toward the inlet 28 has the advantage of separating the catalyst particles. Advantageously, the heavier particles, those containing the most coke, preferentially fall into stripper 16 while the lighter less coked particles enter cyclone inlet 28 and are separated in cyclone 30. However, it is not necessary to the practice of this invention that the feed direct the catalyst in any particular direction.

The feed from distributor 15 preferably contacts the curtain of falling catalyst in a transverse direction to obtain a quick contacting between the feed and the catalyst particles. For the purposes of this description the expression transversely contacting means the feed does not flow parallel to the direction of the falling curtain. The distributor 15 will produce a spray pattern that is compatible with the geometry of the falling curtain. Where the discharge point forms an annular falling curtain of catalyst, the feed injector will produce a radial pattern of flow that passes outwardly to contact the feed. Where the falling curtain has a linear shape as depicted in the figure, the feed injector will generally produce a horizontal pattern of atomized liquid. In any arrangement of hydrocarbon feed and catalyst contacting the mixture moves rapidly towards a separation device such that the hydrocarbons are separated from the catalyst after a contact time of less than 1 second, and preferably, the feed and catalyst mixture enters a separation device after a contact time in a range of 0.01 to 0.5 seconds. After the initial contacting, feed may be directed upwardly or downwardly, but it is preferentially directed toward the inlet 28. Accordingly, in a typical arrangement, the feed is discharged in a substantially horizontal direction to flow perpendicularly into contact with an essentially vertical curtain of catalyst. When contacting the falling curtain of catalyst, the feed will typically have a velocity of greater than 10 ft/sec and may have a velocity of 30 ft/sec or more. Conventional temperatures for the feed are in the range of from 300° to 600° F.

Cyclone 30 provides an inertial separation device that rapidly removes the product vapors from the FCC catalyst. Product vapors are recovered from the cyclone via a line 32 for further separation in a main column separation section. Catalyst separated by cyclone 30 flows down to the bottom of the cyclone where a line 33 removes the catalyst particles. From line 33, the catalyst may be directed into primary stripping zone 16 or displacement stripping zone 18. Typically only one of lines 34 or 60 is provided such that catalyst flows either into primary stripping zone 16 or displacement stripping zone 18. Suitable flow control means (not shown) may also be positioned in conduits 34 or 60 to selectively direct the flow of catalyst from line 33 into one or the other of stripping zone 16 or displacement stripping zone 18.

Line 34 carries catalyst from the cyclone into primary stripping zone 16 where the catalyst is combined with heavier catalyst particles that fall directly into the top of a catalyst bed 36. Stripping fluid, typically steam, enters primary stripping zone 16 via a line 38 and a distributor 40. Primary stripping zone 16 may contain baffles or other internal trays or arrangements to increase contacting between the stripping fluid and the catalyst. As a stripping fluid flows countercurrently to the bed, the stripping fluid primarily displaces hydrocarbons in the upper portion of bed 36 and more fully strips the catalyst by desorbing adsorbed hydrocarbons from the pore volume of the catalyst in the lower portions of bed 36. A line 42 withdraws the most fully stripped catalyst from the bottom of primary stripping zone 16 at a rate controlled by control valve 44. Spent catalyst leaving the stripping zone will typically have an average coke concentration of from 0.5 to 1.0 wt %.

Line 42 transfers spent catalyst to the regeneration zone 12 where a combustion gas carried by a line 46 contacts the catalyst under coke combustion conditions within regeneration zone 12 to remove coke from the catalyst particles. Combustion of the coke generates flue gases that contain the by-products of coke combustion and which are removed from the regeneration zone via a line 48 and are fully regenerated catalyst particles that have a coke concentration of less than 0.2 wt % and preferably less than 0.1 wt/o. Regeneration zone 12 may be any type of known FCC regenerator or arrangement.

A line 50 transports catalyst from the regeneration zone into the blending vessel 14. The blending vessel also receives a portion of the spent catalyst from the reaction zone. A line 52 withdraws spent catalyst from an upper section of primary stripping zone 16 at a rate set by control valve 54. A lift medium such as steam from line 56 pneumatically conveys the spent catalyst upwardly from a line 58 into blending vessel 14. Line 52 withdraws catalyst that has primarily undergone stripping for displacement of hydrocarbons from the void spaces between the catalyst particles.

Displacement stripping zone 18 receives catalyst particles from the cyclone via a line 60. Preferentially the catalyst particles have a lower coke content. A stripping gas enters the bottom of displacement stripper 18 via a line 62 and performs a partial stripping of the catalyst which is, again, to primarily displace hydrocarbons from void spaces between the catalyst particles and to maximize the recovery of wider hydrocarbon products. Spent gas and hydrocarbon products are taken overhead from displacement stripper 18 via a line 64 and either transferred directly back to the reaction zone via a line 66 for recovery in cyclone 30 or removed separately via line 68 for independent recovery in a downstream separation section.

A line 70 removes the stripped catalyst at a rate regulated by a valve 72 for lifting to the blending vessel 14 in a line 74 with the assistance of an appropriate lift gas from a line 76. Blending vessel 14 mixes the catalyst. Blending vessel 14 receives the hot catalyst from line 50 and spent catalyst from either or both of lines 58 and 74.

For purposes of blending and mixing, an additional fluidizing gas may enter blending vessel 14 via a line 78. Blending vessel 14 also provides a degassing function for venting fluidizing gases that convey the catalyst into the vessel. Fluidization gas, entering vessel 14 from line 78 promotes mixing of catalyst within the vessel. Fluidizing gas entering the blending zone will normally establish a superficial velocity of between 0.2 to 3 ft/s. The blending vessel will ordinarily maintain a dense catalyst bed. Conditions within the blending zone typically include a density in a range of from 30 to 45 lb/ft$^3$. Turbulent mixing within the dense catalyst bed fully blends the regenerated and spent catalyst. In this manner, mixing vessel 14 operates at least as a blending zone to supply the blended catalyst streams to the reactor and regenerator. A vent line 80 passes fluidizing gas out of the top of mixing vessel 14.

A standpipe 82 at the bottom of blending vessel 14 supplies the blended catalyst mixture to a slide valve 84 that regulates the addition of the catalyst to the reaction zone. Catalyst from the slide valve enters a discharge chamber 86 that supplies catalyst to a discharge point 88. Discharge point 88 has a shape to form the falling curtain of catalyst 26 that contacts the feed stream 24. The amount of catalyst discharged through discharge point 88 is a function of the size of the discharge point and the pressure head at discharge point 88. The pressure at discharge point 88 may be controlled in a variety of ways. Static pressure head may be provided by varying the height of a standpipe section 90 and by controlling the level in that section through the regulation of catalyst passing through valve 84. A pressurization fluid may also be injected into discharge chamber 86 via a line 92. The pressurization fluid may provide a fluidizing function to maintain flow through discharge point 88 or may be used to increase the pressure in chamber 86 and to adjust the velocity of the curtain of catalyst passing through the discharge point. The falling curtain of catalyst will usually have a velocity of at least 5 ft/sec. The velocity through the discharge point may be increased in order to carry the mixture of hydrocarbon and catalyst farther down into the reactor vessel thereby lengthening the flow path and the residence time of the hydrocarbons within the reaction zone.

Figure 2:
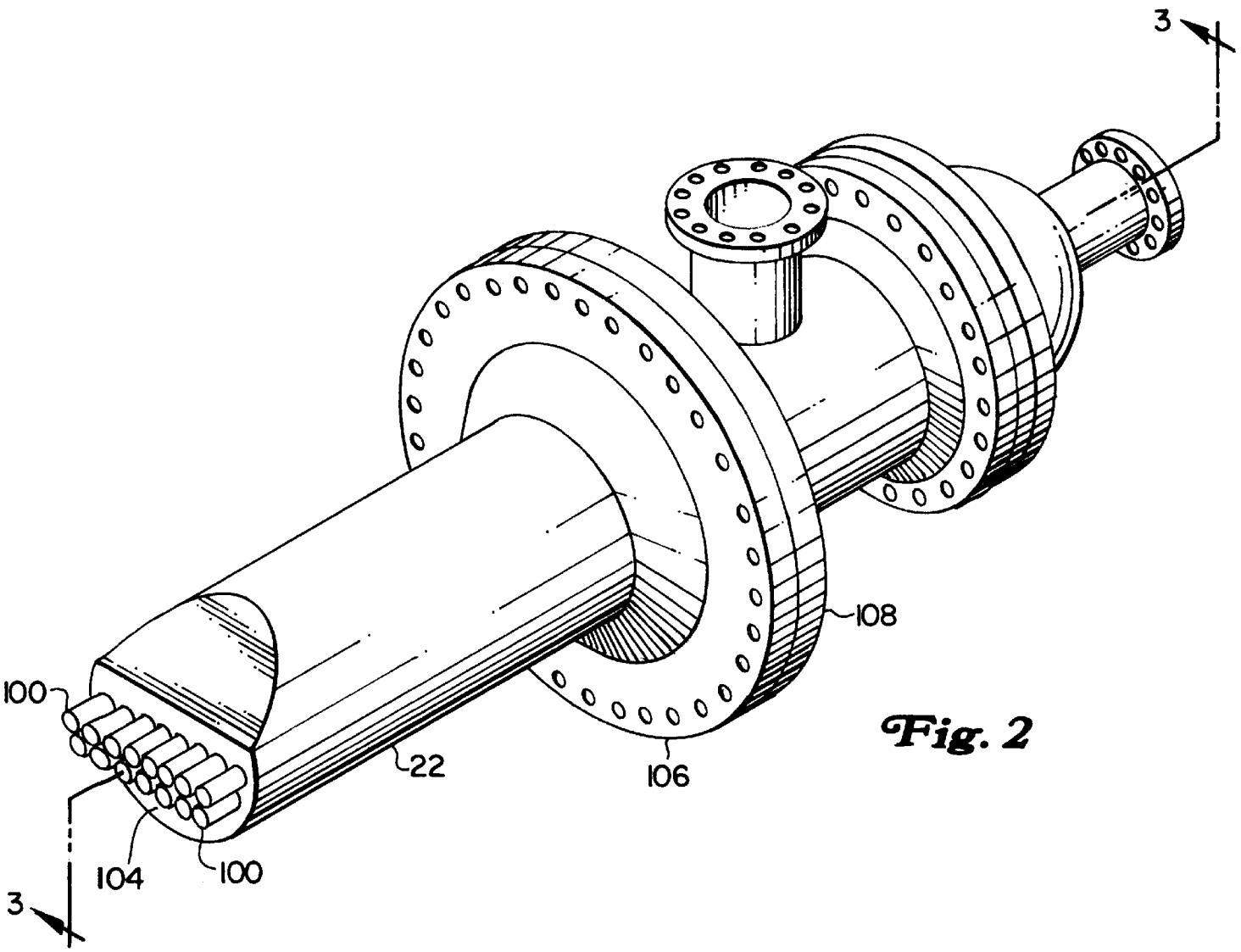
FIG. 2 is an isometric view of the distributor depicted in FIG. 1.
Figure 3:
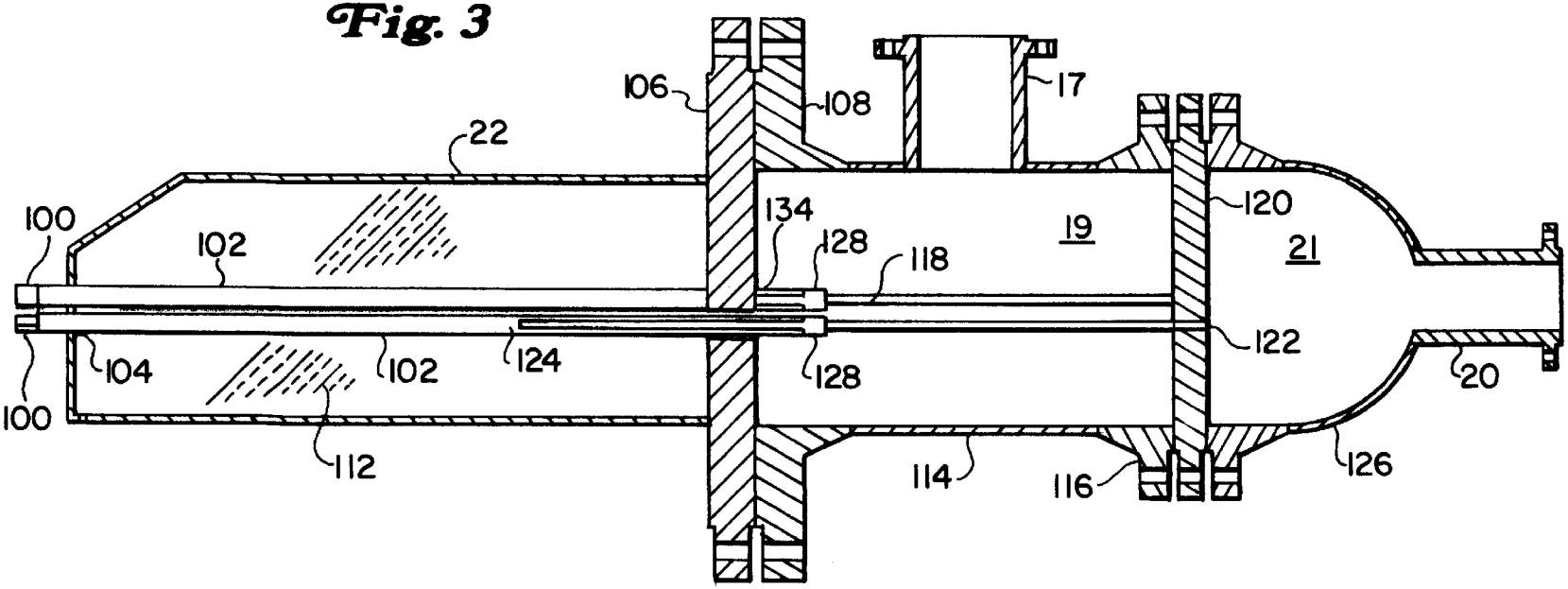
FIG. 3 is a side view of the distributor of FIG. 2.

FIGS. 2 and 3 show the nozzles 100 for creating discrete jets 24. Nozzles is 100 are typically sized to provide a fluid velocity out of openings in a range of from 10 to 400 feet per second and preferably in the range of 100 to 300 ft/sec. In accordance with typical FCC practice, the feed exits the nozzle openings 100 as a spray. Droplet size within the spray and the velocity of the spray determines momentum of the feed as it enters the interior of vessel 10. It is difficult to increase the momentum of the feed above a given level since the velocity of the feed injection is inversely proportional to the size of the droplets in the emanating spray. Higher velocities for the spray tend to directly increase the momentum of the spray but indirectly decrease the momentum by reducing the size of the exiting droplets. Conversely, the reduced momentum that results directly from lower spray velocities is offset by the typical production of larger droplets. In the preferred practice of this invention where the fluid entering the jets comprises a substantially liquid oil feed, lower jet velocities are preferred.

The dispersion of the feed into yet finer droplets is promoted by imparting sufficient energy into the liquid. Where desired any of the prior art methods may be used in combination with the feed injection arrangement of this invention. In some cases, this invention will be practiced with some addition of a gaseous diluent such as steam to the feed before discharge through the orifices. The addition of the gaseous material can aid in the atomization of the feed. In some cases a minimum quantity of gaseous material, equal to about 0.2 wt. % of the combined liquid and gaseous mixture, may be commingled with the liquid before its discharge through the nozzles. Typically the quantity of any added steam is 5 wt % or less of the combined gaseous and liquid mixture. The liquid or feed entering the distributor 15 through chamber 19 will usually have a temperature below its initial boiling point but a temperature above the boiling point of any steam or gaseous medium that enters the distributor 15 along with the liquid.

FIG. 2 shows a preferred outer arrangement for distributor 15. The nozzles 100 are supported by a face 104 on the outer end of shroud 22. A blind flange 106 retains shroud 22 and a plurality of outer conduits 102 can be formed from piping or tubing. Flange 106 is used as an integral part of the shroud. Bolting blind flange 106 to an open flange in contacting vessel 10 facilitates insertion and removal of distributor 15. As shown in FIG. 1 a flange 13 on the outside of reactor 10 and a flange 108 work together to sandwich blind flange 106 into position in the contacting vessel. Bolting of flange 108 into position on flange 13 positions shroud 22 at the desired location within reactor vessel 10.

Blind flange 106 provides support to both ends of outer conduits 102. Blind flange 106 fixes both the inner end of shroud 22 and one end of outer conduits 102. At a location proximate to nozzles 100, outer conduits 102 receive support from flange 106 through shroud 22 to inhibit vibration and displacement of the inner ends of conduits 102 within reactor 10.

Shroud 22 may have a generally cylindrical shape or any shape that suits the location into which it is inserted into a contacting zone and provides adequate stiffness to guide the otherwise unsupported ends of conduits 102. However, shroud 22 may be an open structure that provides sufficient rigidity to prevent vibration or damage to outer conduits 102. Preferably shroud 22 is essentially closed to maximize protection and support of the conduits. The cylindrical shape is preferred since it also accommodates location of the distributor into a traditional pressure vessel as well as an FCC standpipe which may provide the location for shaping of the catalyst flow. The interior of shroud 22 may be filled with insulating material 112 such as fibrous blanket insulation or refractor lining materials to reduce the temperature within the shroud.

Depending upon the location of the shroud, additional abrasion resistant linings may be provided on the outside to protect it from erosion. In most cases, the contacting vessel will not expose the distributor to significant concentrated flows of catalyst. The flow of catalyst into which the nozzles inject the dispersed fluid is spaced away from the nozzles so that under ordinary circumstances direct erosion from catalyst will not have a significant impact on the nozzles of distributor 15. However, for those unusual circumstances where there is disruption in the flow path of catalyst any arrangement that places the exposed nozzles outside of shroud 22 should use an abrasion-resistant material for the nozzles such as a stellite or other erosion-resistant metals that are well known to those skilled in the art.

Front face 104 of shroud 22 provides at least means for guiding that inhibits or prevents transverse displacement of the outer conduits 102 and their attached nozzles 100. Shroud 22 may rigidly retain the outer conduits 102. Preferably face 104 will have discrete holes that surround the conduits or nozzles and provide a sliding fit that guides the conduits and nozzles to permit thermal expansion of conduits 102 relative to the shroud 22. A plate edge may provide a smooth surface upon which the conduits 102 or nozzles 100 rest to guide the end of the nozzles while providing a sliding support that again allows for relative expansion between the shroud and the conduits. Such a plate edge may also define a groove or channel that inhibits sideways movement of nozzles 100. Nozzles 100 may be located in face 104 or may be stepped inwardly from face 104 and supported by an appropriate channel or other structure located in the inner end of shroud 22. The channel will preferably have rounded lead and trailing edges to permit smooth movement of the conduits or nozzles through the channel.

Figure 4:
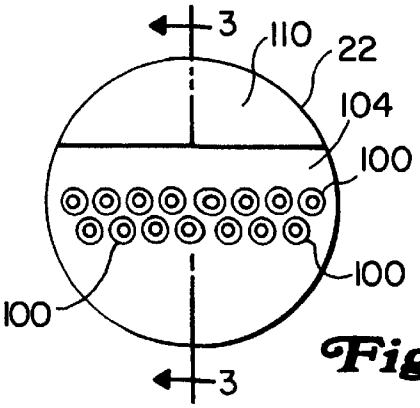
FIG. 4 is a partial front view of the distributor of FIG. 2 showing the section line for FIG. 3.

The preferred arrangement of the invention as shown in FIG. 4 has the nozzles disposed as a linear array across face 104. The nozzles are arranged above and below the center line of the linear array which may be offset from the parallel center line of the cylindrical outline of shroud 22 in upper and lower rows. The nozzles are spaced to provide a broad band of linear feed contacting in a desired flow pattern. Nozzles 100 may be designed to provide any desired flow pattern of dispersed and atomized liquid out of each nozzle. The nozzles may have an outlet configuration that provides a concentrated cylindrical jet or may be arranged to provide fan shaped patterns to increase the vertical distance over which the dispersed liquid contacts the dispersion of moving catalyst particles.

At the inner end of the shroud 22, flange 106 forms part of a chamber wall 114 that together with a flange 116 and a blind flange 120 define the chamber 19. Chamber 19 may be used for the distribution of feed or gaseous phase fluids. Fluid from chamber 19 flows into annular areas defined, at least in part, between inner conduits 118 and the ID of outer conduits 102. A blind flange 120 retains inlet ends of inner conduits 118 which like conduits 102 can be formed from tubing or piping.

Inner conduits 118 have inlets 122 that communicate with chamber 21. A flanged end closure 126 retains the nozzle 20 and together with blind flange 120 defines the chamber 21. Chamber 21 again may receive either hydrocarbon feed or a gaseous phase fluid. At the location of blind flange 106, the inner conduits 122 enter the outer conduits 102, in a preferred coaxial alignment, and extend along a linear path through conduit 102. An outlet 124 of inner conduit 118 discharges a fluid into conduit 102. Fluid from conduit 118 initially enters the outer conduit 102 as a linearly directed flow stream. The fluid streams begin to mix as fluid from conduit 118 enters conduit 102 from outlet 124 and continue to mix as they pass to one of nozzles 100. The diameter and length of outer conduits 102 are sized to provide sufficient time for blending of the gas and liquid stream before exiting nozzles 100. The open length of conduit 102 downstream of outlet 124 may be adjusted as necessary to provide the desired amount of mixing. The outlet of conduit 124 may be positioned closer to or farther from nozzles 100 to reduce or increase the amount of mixing in outer conduit 102. Inlet ends 134 of outer conduit 102 may be extended into chamber 19 as desired. Each inner and outer conduit pair receives a portion of the feed and gas entering the chambers 19 and 21 and maintains the mixture as a discrete stream that is separate from the other streams of fluid mixed in the additional pairs of conduits 102 and 118.

Figure 5:
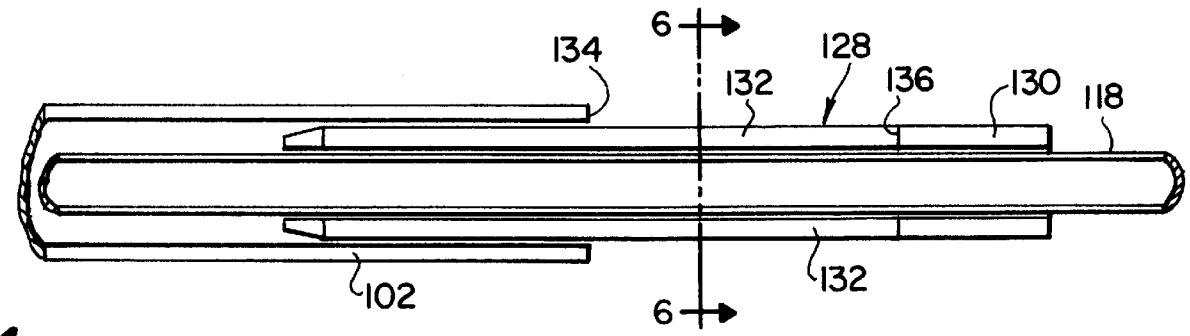
FIG. 5 is an enlargement of a sectioned tube portion of FIG. 3.

At least one set of restrictors is used to distribute in either chambers 19 or 21 and to form discrete fluid substreams of gas or liquid or both. The fluid preferably enters each conduit inlet in equal amounts. Inlet 122 of inner tubes 119 may be restricted to provide pressure drop across blind flange 120 and insure an even distribution of fluid into inlets 122. In some arrangements where the pipes are small enough in diameter, they will provide adequate pressure drop to assure uniform delivery of liquid and any gas. Flow restrictors 128 are a specific form of flow restrictor suitable for use in this invention which may occupy a portion of an annular inlet area defined between the inside of outer conduit 102 and the outside of inner conduit 118 to introduce pressure drop for evenly distributing the fluid into conduits 102. Suitable baffling may be provided across the inlets of nozzles 17 and 20 to break up any jet of fluid from the nozzle that may disrupt the even distribution of flow and to protect upper conduits 118 from excessive force during transient conditions. As shown in FIG. 5, restrictors 128 may extend into chamber 19 to provide direct communication of fluid from chamber 19 across the flow restrictors into outer conduits 102.

Figure 6:
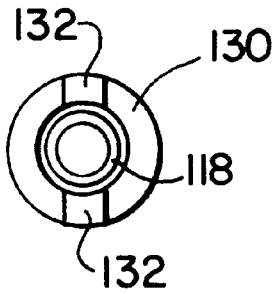
FIG. 6 is a section of FIG. 5.
Figure 7:
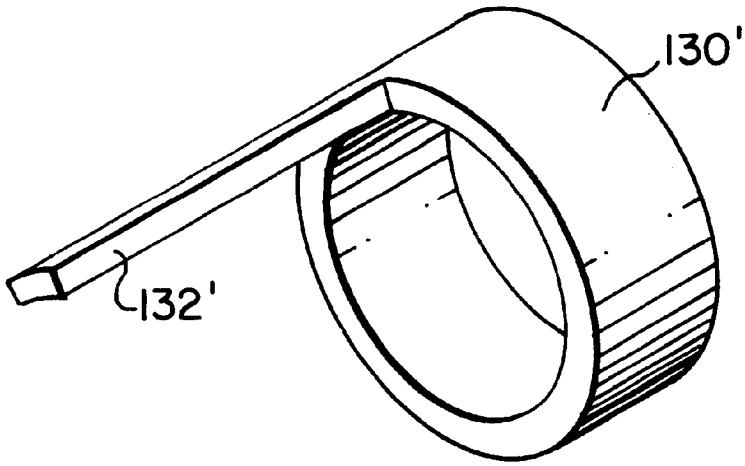
FIG. 7 is an isometric view showing a modified portion of a restrictor depicted in FIGS. 5 and 6.

Flow restrictors 128 may, in addition to a flow distribution function, serve as stabilizers for reducing the unsupported length of inner conduits 118 and thereby minimize vibration. The particular arrangement of FIGS. 5 and 6 shows the restrictor having a collar section 130 that surrounds inner conduit 118. An arrangement of four fingers 132, in the form of substantially rectangular bars, extends from collar 130 into the annulus formed between outer conduit 102 and inner conduit 118. The outsides of fingers 132 are kept in close contact with the inside of outer conduit 102 to minimize the transverse displacement of inner conduit 118 and to reduce vibrational movement. The open area between the inlet 134 of outer conduit 102 and the base 136 of collar 130 from which the fingers 132 extend provides a flow path for fluid from chamber 19 to enter the annular area between the outside of inner conduit 118 and the inside of outer conduit 102. FIG. 7 shows the junction of modified collar 130' with a single finger 132' extending therefrom which may be used to minimize the restriction of flow into the annular area. Preferably multiple fingers are used to provide additional vibrational stability The number and width of fingers 132 may be increased where necessary to provide the desired pressure drop. Alternately when blocking most of the annular area the fingers may comprise semi-circular segments that define grooved flow channels.

Flow restrictor 128 may be held in place by any method such as welding the restrictor 128 to inner conduit 118 or outer conduits 102. Fixing of the flow restrictor to inner conduit 118 will typically facilitate assembly and disassembly of the conduit arrangement. Retaining the inner conduits 118 in blind flange 120 allows the inner conduit and restrictor assembly to be removed from the outer conduits for replacement or repair of the inner conduits as well as cleaning or repair of the outer conduits. Moreover, fixing the shroud and outer conduit assembly to blind flange 106 facilitates replacement or alteration of nozzles, nozzle projection, and outer tube configurations.

What is claimed is:

1. A method of injecting a substantially linear array of feed jets comprising at least partially liquid phase hydrocarbon compounds and a gas phase fluid into a stream of fluidized particles, said method comprising:

passing a dispersion of catalyst particles through a contacting vessel in a predetermined flow pattern;

dividing a stream of hydrocarbon compounds into a plurality of uniform hydrocarbon substreams in a first chamber by passing the stream of hydrocarbon compounds into first inlets of different conduits in a plurality of first conduits extending through a second chamber;

dividing a stream of gas phase material into a plurality of uniform gas substreams in the second chamber by passing each of the gas substreams into inlets second of different conduits in a plurality of second conduits, said second inlets being enclosed within said second chamber and said second conduits extending through a shroud adjacent said second chamber;

passing the hydrocarbon substreams along linear paths through conduits of the enclosed first or second plurality of conduits to produce a plurality of linearly directed flow streams;

passing the gas substreams through flow restrictors located inside said second chamber to provide a plurality of restricted flow streams;

combining each one of the gas substreams with one of the hydrocarbon substreams at a location downstream of the flow restrictors and the linear flow path in the conduits of the first plurality of conduits to provide a plurality of combined streams directed along a linear flow path;

maintaining the plurality of combined streams as discrete streams;

injecting the discrete streams through outlet ends of the plurality of second conduits exiting an end wall of the shroud into different portions of the predetermined catalyst flow pattern.

2. The method of claim 1 wherein an inner end of the shroud guides the outlet ends of each conduit that delivers the combined stream to each outlet end.

3. The method of claim 2 wherein an outer end of the shroud and an upstream portion of each conduit guided by the shroud are fixed with respect to each other.

4. The method of claim 1 wherein the outer end of the shroud extends into the contacting vessel.

5. The method of claim 1 wherein the predetermined pattern is primarily planar.

6. The method of claim 1 wherein the catalyst has a velocity of at least 5 ft/sec when it is contacted by the discrete streams.

7. The method of claim 1 wherein the hydrocarbon compounds are atomized to a particle size of from 50 to 750 microns by discharge from the nozzles.

8. The method of claim 1 wherein each discrete stream is discharged at a velocity of at least 30 ft/sec.

9. The method of claim 1 wherein said gas comprises steam and the amount of steam is equal to 0.2 to 5 wt % of the combined streams.

10. The method of claim 1 wherein the outlet ends provide a substantially linear array of discrete streams.

11. The method of claim 10 wherein the line an array of discrete stream is provided by two vertically offset rows of spray nozzles.

12. The method of claim 1 wherein a portion of each conduit in the plurality of first conduits pass through the second chamber and holes in the portion of each conduit provide the second inlets of the conduits in the plurality of first conduits and the flow restrictors.

13. An apparatus for injecting a plurality of discrete jets into an extended dispersion of moving catalyst particles within a contacting vessel, the apparatus comprising:

chamber walls defining a first chamber for receiving a first fluid stream and a second chamber for receiving a second fluid stream;

a plurality of first conduit sections in communication with said first chamber and extending within and along distinct areas in said second chamber;

a plurality of second conduit sections wherein each conduit section of the first conduit sections communicates with a different second conduit section and each second conduit section has communication with the second chamber;

at least one flow restrictor supported or defined at least in part by each of said first conduit sections, each restrictor located within and communicating with the second chamber and communicating with the interior of at least a first conduit section or a second conduit section to restrict fluid flow from the second chamber into the second plurality of conduit section;

a nozzle at an outer end of each of the second conduit sections;

a shroud fixed about an inner end with respect to the second chamber and positioned to restrict transverse displacement of the second conduit sections which are at a location proximate to the outer ends of the second conduit sections that extend out of said shroud.

14. The apparatus of claim 13 wherein the nozzles are transversely spaced along a line to provide a linear array of the nozzles.

15. The apparatus of claim 14 wherein the nozzles are spaced along several lines alternate from a location above the line to a location below the line.

16. The apparatus of claim 13 wherein the second conduit sections extend into the second chamber and each conduit section of said first plurality of conduit sections extends coaxially into a different conduit section of the second plurality of conduit sections.

17. The apparatus of claim 13 wherein the flow restrictors occupy annular regions defined by the outside of the conduits in the first plurality of conduit sections and the inside of the conduits in the second plurality of conduit sections.

18. The apparatus of claim 17 wherein at least a portion of the flow restrictors extends into the second chamber to provide direct communication from the interior of the second chamber to the flow restrictors.

19. The apparatus of claim 17 wherein the flow restrictors comprise at least one extended finger.

20. The apparatus of claim 19 wherein the flow restrictors comprise a plurality of axial extended fingers.

21. The apparatus of claim 13 wherein the second conduit sections pass through discrete holes at the inner end of the shroud to provide the restriction of transverse displacement.

22. The apparatus of claim 13 wherein said outer end of said shroud comprises a flange for positioning said shroud in a contacting vessel.

23. The apparatus of claim 13 wherein said shroud comprises a cylindrical portion and the interior of the cylindrical portion is insulated.

24. An apparatus for injecting a plurality of discrete jets into an extended dispersion of moving catalyst particles within a contacting vessel, the apparatus comprising:

chamber walls defining a first chamber for receiving a first fluid stream and a second chamber for receiving a second fluid stream;

a plurality of inner conduits extending in parallel alignment within and into the second chamber with each conduit having an inlet end in communication with the first chamber and having an outlet end;

a plurality of outer conduits having a relatively smaller diameter than the inner conduits, each outer conduit having a coaxial alignment with a different inner conduit and surrounding the outlet end of its coaxially aligned inner conduit, each outer conduit having an inlet in communication with the second chamber and each outer conduit having an outlet end opposite the inlet, the outer conduits being enclosed within a shroud adjacent the second chamber and the outlet end of each outer conduit extending outwardly of said shroud;

a plurality of flow restrictors located within said second chamber with each flow restrictor surrounding the outside of an inner conduit and extending at least partially into each outer conduit at a location upstream of the inner conduit outlet ends;

a nozzle at the outlet end of each of the outer conduits;

a shroud fixed about an inner end with respect to the second chamber and positioned to restrict transverse displacement of the outer conduit ends.

* * * * *

UNITED STATES PATENT AND TRADEMARK OFFICE

CERTIFICATE OF CORRECTION

PATENT NO. : 6,165,353
DATED : December 26, 2000
INVENTOR(S) : Brandon S. Carpenter et al.

It is certified that error appears in the above-identified patent and that said Letters Patent is hereby corrected as shown below:

Column 12,
Line 1, replace "inlets second" with -- second inlets --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*